US006453521B1

(12) United States Patent
Dischler

(10) Patent No.: US 6,453,521 B1
(45) Date of Patent: Sep. 24, 2002

(54) MULTIPLE PITCH ZIPPER

(75) Inventor: Louis Dischler, Spartanburg, SC (US)

(73) Assignee: Delphi Oracle Corp., Spartanburg, SC (US)

( * ) Notice: Subject to any disclaimer, the term of this patent is extended or adjusted under 35 U.S.C. 154(b) by 0 days.

(21) Appl. No.: 09/803,332

(22) Filed: Mar. 8, 2001

(51) Int. Cl.[7] ..... A44B 19/02
(52) U.S. Cl. ..... 24/406; 24/403
(58) Field of Search ..... 24/33 A, 33 B, 24/33 C, 33 F, 33 K, 33 L, 33 M, 33 P, 33 R, 33 V, 391–414, 585.1–585.12, 589.1

(56) References Cited

U.S. PATENT DOCUMENTS 1,015,783 A * 1/1912 Conn ..... 24/33 C
1,219,881 A 3/1917 Sundback
2,394,211 A 2/1946 Siff
2,578,442 A * 12/1951 Morin ..... 24/404
2,701,401 A * 2/1955 Dorman ..... 24/404 X
2,912,732 A * 11/1959 Stolz et al. ..... 24/33 C
3,540,090 A * 11/1970 Takamatsu ..... 24/408 X
3,735,451 A * 5/1973 Haythornthwaite ..... 24/33 C
3,977,051 A * 8/1976 Takamatsu ..... 24/404
4,000,545 A * 1/1977 Takamatsu ..... 24/404
4,137,034 A 1/1979 Moertel
4,308,645 A * 1/1982 Hasegawa ..... 24/404
4,418,449 A 12/1983 Heimberger et al.
4,611,367 A * 9/1986 Meulenberg et al. ..... 24/33 P
5,327,823 A * 7/1994 Clevenger, Jr. et al. .. 24/33 P X

* cited by examiner

*Primary Examiner*—Robert J. Sandy
*Assistant Examiner*—Ruth C. Rodriguez

(57) ABSTRACT

A zipper including two stringers, each stringer having a row of coupling elements having a plurality of coupling element spacings, and at least one stringer having a plurality of coupling element widths.

24 Claims, 3 Drawing Sheets

FIG. 1
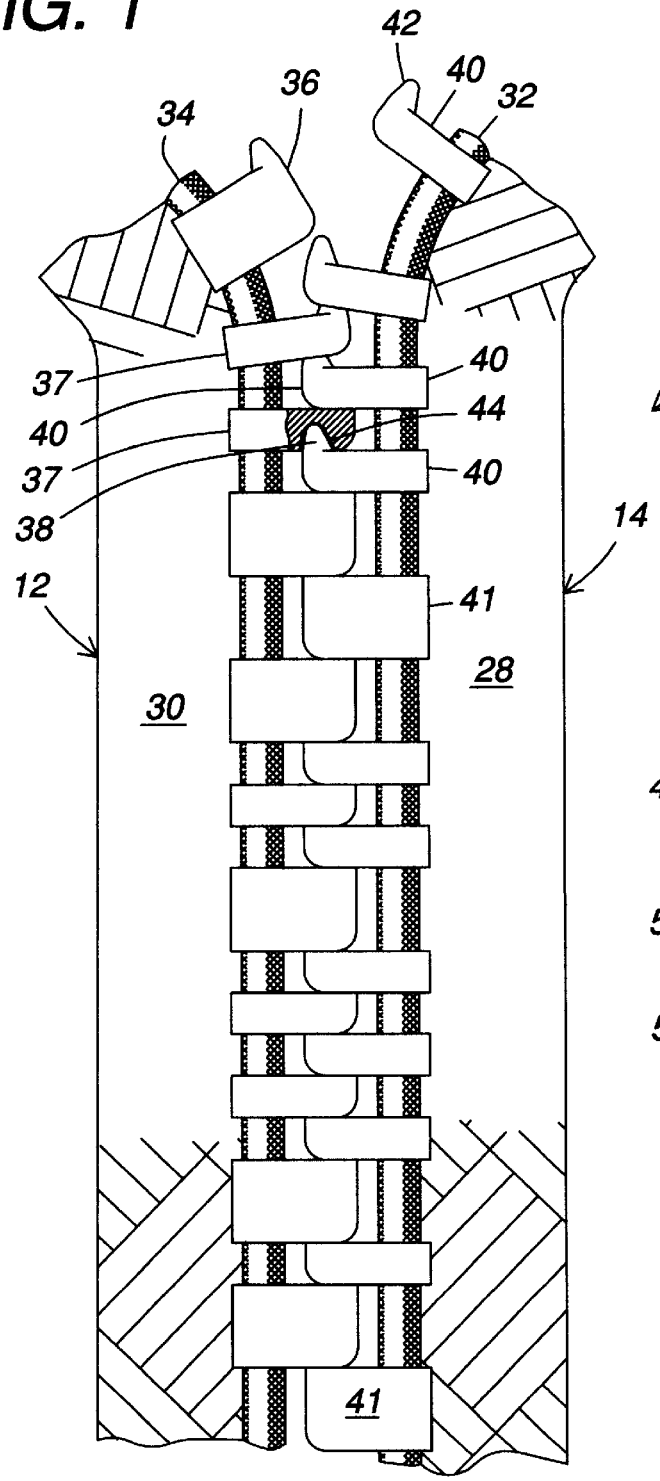
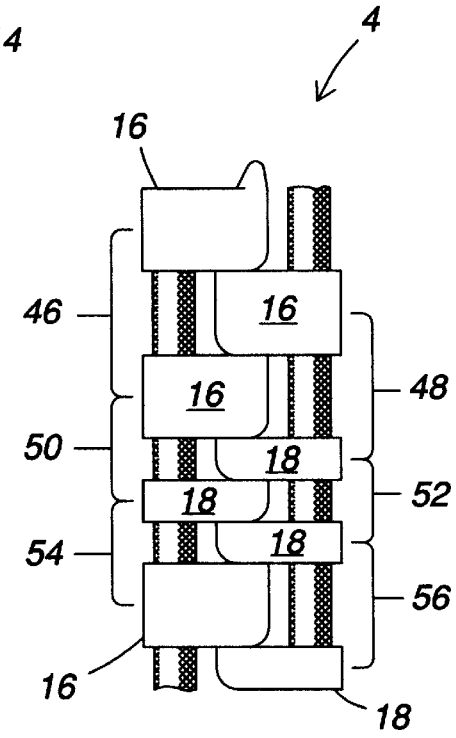
FIG. 2

FIG. 3
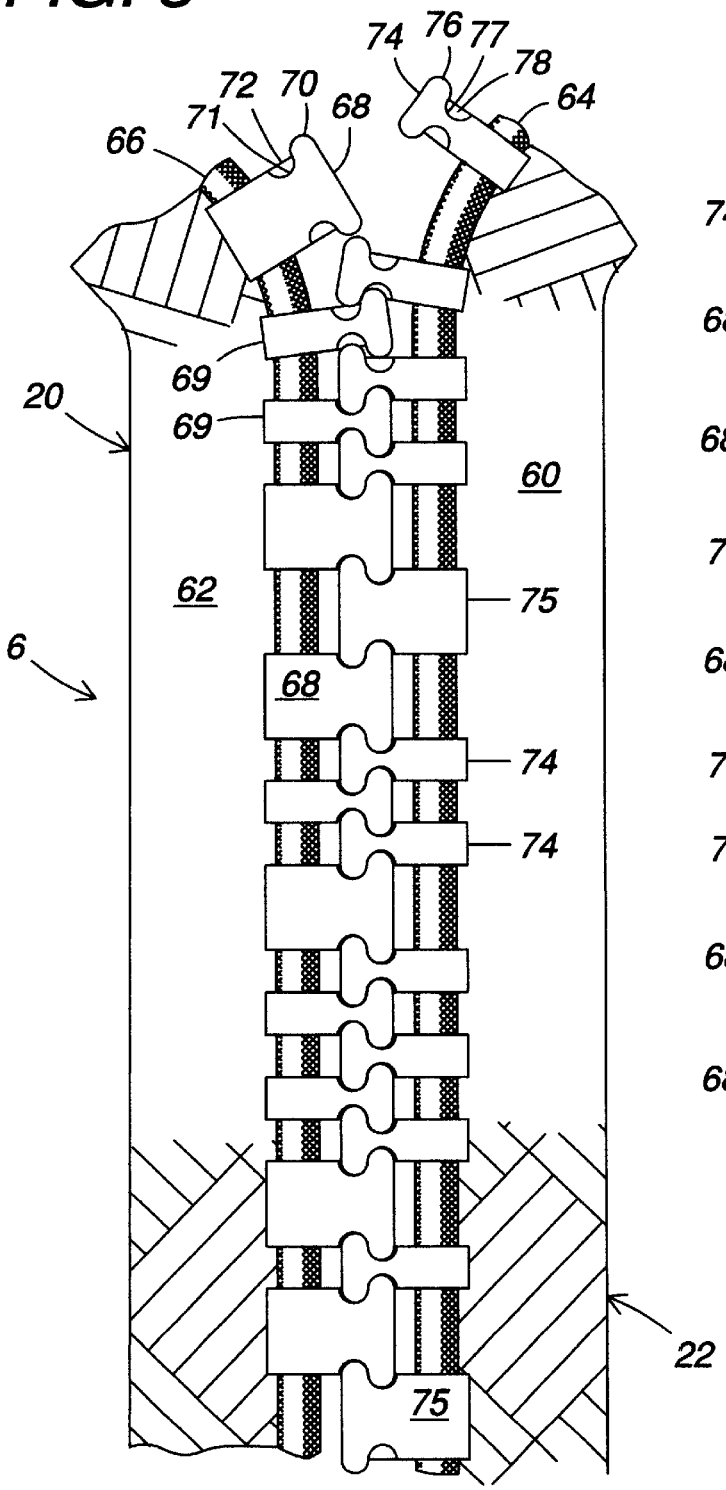
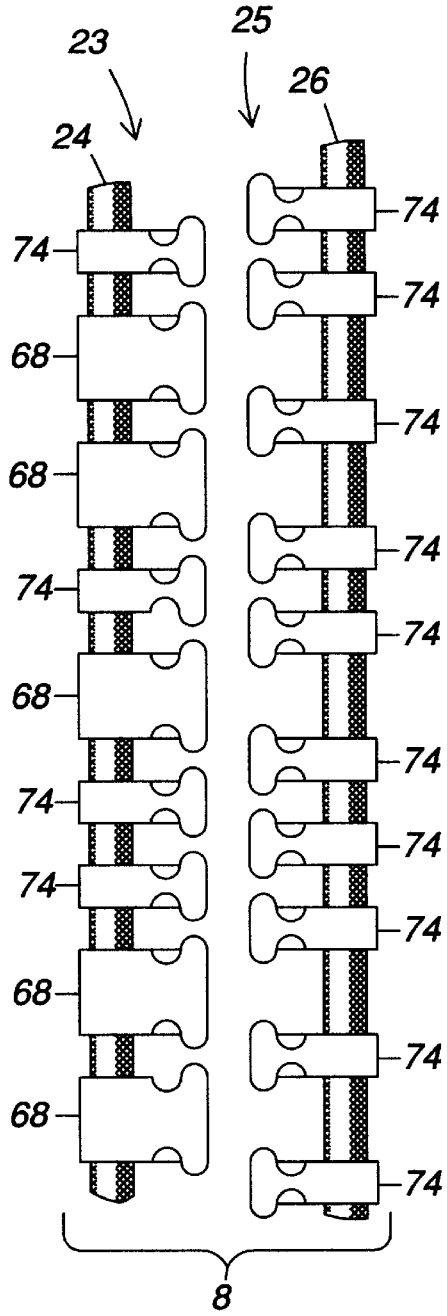
FIG. 4

MULTIPLE PITCH ZIPPER

FIELD OF THE INVENTION

This invention relates to sliding fasteners, and more particularly to zippers having interlocking coupling elements alternately attached to separate stringers.

BACKGROUND OF THE INVENTION

While the major function of a zipper assembly is mechanical—to reversibly couple two generally planar items together, aesthetic considerations also arise which may dictate when and how a zipper may be use in a given application. The aesthetic considerations are aural, tactile and visual. The present invention alters the visual aspect of the zipper assembly to provide a less mechanical appearance, while at the same time generally altering the sound and feel of the zipper when it is opened and closed.

SUMMARY OF THE INVENTION

The present invention provides for a zipper assembly comprising two stringers, each stringer having a row of coupling elements having a plurality of different coupling element spacings, and at least one stringer having a plurality of different coupling element widths.

A "coupling element" is herein defined as a substantially rigid projection arrayed along a strip and/or cord in a spaced fashion with other substantially rigid projections to form a stringer, the rigid projection having surface geometry for mechanical interlocking with mating surface geometry of two adjacent projections on a mating stringer. A "stringer" is defined as a flexible zipper half having a linear array of coupling elements, capable of coupling to a second linear array of coupling elements (e.g., by means of a slider, whereby the coupling elements on the stringers are temporarily rotated to allow them to be interleaved, then straightened to geometrically interlock them with adjacent mating coupling elements). A "slider" is defined as a moveable element having a pair of channels for reversibly directing the two arrays of non-interlocked coupling elements of the stringers through a curved coupling path and into a parallel interlocked relationship. The use and construction of sliders is well known to those versed in the art. A "zipper" is defined as two mating stringers, while a "zipper assembly" is defined as a zipper comprising a slider. The "pitch line" of the zipper is defined as the line that bisects the coupling elements of a closed zipper. The "coupling element spacing", or "pitch", is defined as the distance along the pitch line and between the center of a stringer coupling element to the center of the next adjacent coupling element on the same stringer. The "width" of a coupling element is measured along the pitch line of the zipper, and is equal to one half of the coupling element spacing of a closed zipper having identical coupling elements. The "pitch sequence" of the zipper is defined as the consecutive listing of the coupling element widths of the zipper when closed.

In a preferred embodiment, the second stringer pitch sequence has a reversed relationship to the first stringer pitch sequence, to produce a palindromic zipper. For instance, if the first stringer pitch sequence is ABBAAA, where "A" and "B" represent short and long coupling elements, respectively, then the second stringer pitch sequence would be aaabba, and the assembled zipper pitch sequence would be AaBaBaAbAbAa. (In this example, upper and lower case are used only to distinguish the stringers on which the coupling elements reside.) The first coupling element spacing on the first stringer, starting from the left end, would be 1.5 times the "A" width plus 0.5 times the "B" width; while the second coupling element spacing on this stringer would be the "A" width plus the "B" width. Using only two coupling element widths, there are a minimum of two and a maximum of five coupling element spacings. If three coupling element widths were used, there would be a maximum of ten coupling element spacings. As may be appreciated, the maximum number of coupling element spacings increases dramatically as the number of coupling element spacings increases.

In another preferred embodiment, a stringer pitch sequence is periodic, e.g., ABABAB, or ABCCABCC. In another embodiment, the sequence may be selected to carry information in coded form, e.g., the stringer coupling element widths or assembled zipper pitch sequences may use a code such as Morse code to spell out a brand name or other information, in order to make counterfeiting of items incorporating the zipper more difficult. In yet other embodiments, the sequence may be non-repeating; the coupling element widths of one stringer may be different from the coupling element widths of the mating stringer; and the number of coupling element widths on one stringer may be different from that of the mating stringer, e.g., one stringer may have only one coupling element width (but a plurality of coupling element spacings) while the mating stringer has two or more coupling element widths. In every embodiment of the present invention, each stringer of a zipper assembly has a plurality of coupling element spacings, and at least one stringer also has a plurality of coupling element widths.

When the zipper is opened or closed, friction and impact of the closure elements within the slide and interaction of the closure elements of one stringer with the closure elements of the mating stringer create noise and vibration that are sensed by the user. The aesthetic character of these effects are dependent in some degree upon the spacing of the closure elements and therefore may be modified and enhanced by suitable choice of spacings provided by the present invention.

It is preferred that coupling element spacings within a stringer vary at least once by at least about one percent, more preferably by at least 5%, and most preferably by at least 10%; and it is more preferred that the coupling element spacings alternate between at least two values at least 5 times, and most preferably at least 10 times.

The coupling elements may be metallic or polymeric, but are preferably generated from thermoplastic materials, e.g., by continuous injection molding on a form wheel and form band. Such a manufacturing method is described in U.S. Pat. No. 4,137,034, the teachings therein entirely incorporated herein by reference. The surface geometry that interlocks a given coupling element with an adjacent coupling element may comprise male and female projections that prevent relative movement in both the plane of zipper and in the direction orthogonal to the plane. Alternatively, mating projections may be used to prevent movement in the zipper plane, with separate projections to prevent motion orthogonal to the plane. End stops can be provided at each end of each stringer.

It is an object of the present invention, therefore, to provide a zipper having improved visual aesthetics.

It is another object of at least one embodiment of the invention to provide a zipper having improved tactile and aural aesthetics when opened and closed.

It is another object of at least one embodiment of the invention to provide a zipper having variable pitch.

It is another object of at least one embodiment of the invention to provide a zipper having information coded in the zipper pitch sequence.

BRIEF DESCRIPTION OF THE DRAWINGS

The above as well as other objects of the invention will become more apparent from the following detailed description of the preferred embodiments of the invention, when taken together with the accompanying drawings in which:

FIG. 1 is a plan view of a partially closed zipper section according to one embodiment of the invention.

FIG. 2 is a plan view of a portion of the zipper section shown in FIG. 1.

FIG. 3 is a plan view of partially closed zipper section according to one embodiment of the invention.

FIG. 4 is a plan view of two uncoupled complementary stringer segments.

DETAILED DESCRIPTION OF THE PRESENTLY PREFERRED EMBODIMENTS

Figure 5:
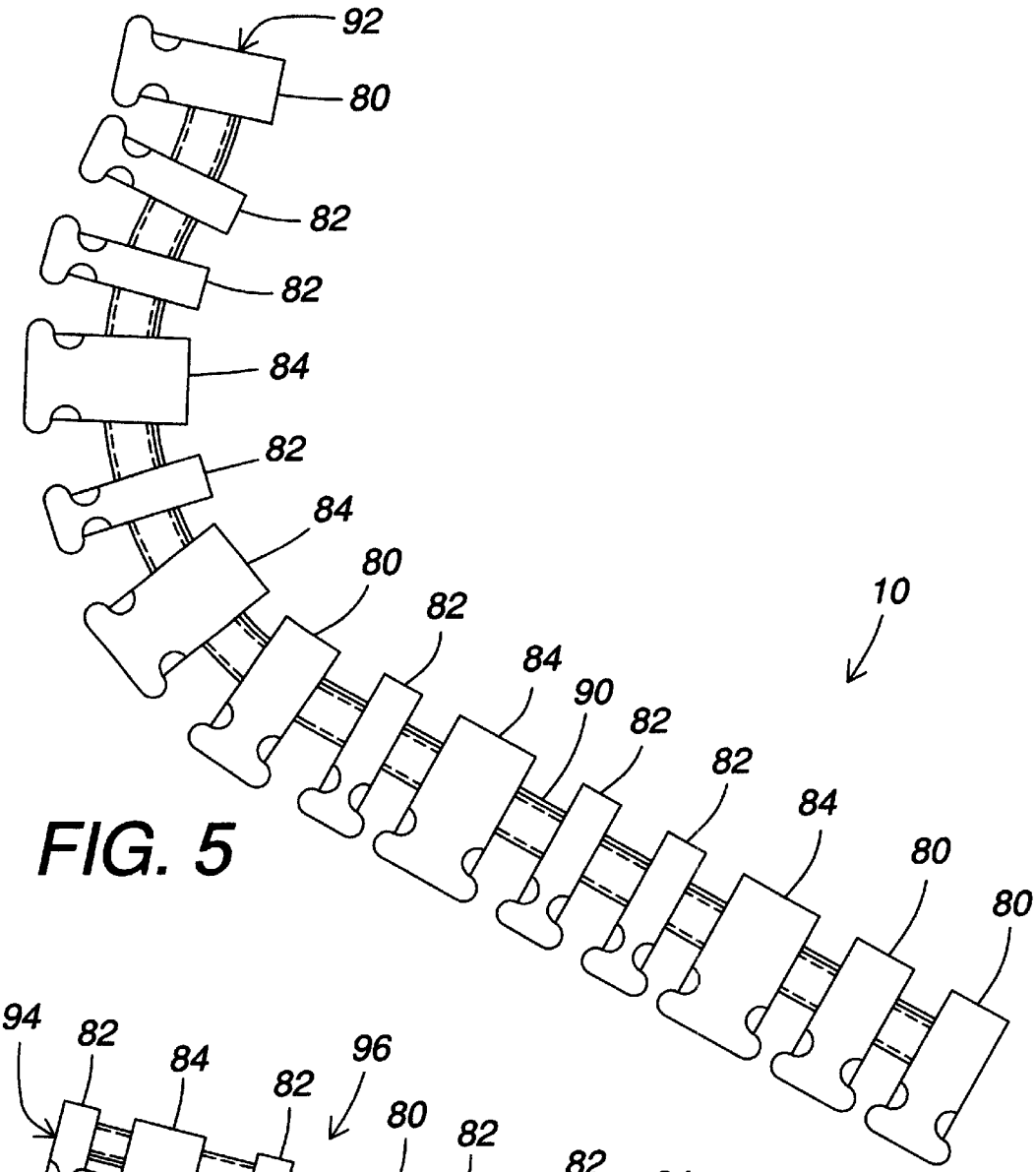
FIG. 5 is a plan view of a segment of a stringer carrying coded information.

Referring now to the drawings wherein like numerals refer to like parts, FIG. 1 illustrates a partially closed zipper 2 comprised of left and right stringers 12, 14. Left stringer 12 is comprised of strip 30 attached to cord 34 which carries a plurality of coupling elements 36, 37 having different widths. Right stringer 14 is comprised of strip 28 attached to cord 32, carrying a plurality of coupling elements 40, 41 for interlocking with coupling elements 36, 37. A projection 38 extending from one side of coupling element 37 mates with recess 44 of coupling element 40 so as to substantially prevent relative motion of the elements. Coupling projections for zipper elements are well known, e.g., as described in U.S. Pat. No. 1,219,881, the teachings of which are fully incorporated by reference.

In FIG. 2, a zipper section 4 is shown to have five different spacings 46, 48, 50, 52 and 56. (Spacing 54 is equal to spacing 50.) Using coupling elements 16, 18 having only two widths provide a minimum of two and a maximum of five different spacings.

Turning now to FIG. 3, a partially closed zipper 6 is comprised of left and right stringers 20, 22. Left stringer 20 is comprised of strip 62, which is attached to cord 66 carrying coupling elements 68, 69. Right stringer 22 is comprised of strip 60 attached to cord 64 that carries coupling elements 74, 76. Coupling elements 69, 74 have the same width, as do coupling elements 68, 76. As shown, the individual elements of coupling element pairs 69, 74 and 68, 76 are identical, but are rotated 180 degrees. However, they need not be identical so long as they are capable of interlocking. The pitch sequence of zipper 6 is the same as the pitch sequence of zipper 2 shown in FIG. 1, however the coupling elements use a different surface geometry for coupling with adjacent coupling elements. At the uncoupled end of zipper 6, ledge 72 of coupling element 68 will interlock with the lower surface of head 76 of coupling element 74 (having ledge 78). The side surfaces of head 76 mate with the recesses 71, and the side surfaces of head 70 mate with the recesses 77. Such interloclkng geometry is described in U.S. Pat. No. 4,418,449, and the teachings therein are entirely incorporated by reference. Similar geometry is described in U.S. Pat. No. 2,394,211, the teachings of which as also incorporated by reference.

A pair of stringers 23, 25 comprise the open zipper 8 shown in FIG. 4. The left stringer 23 is comprised of cord 24 and spaced coupling elements 68, 74 having two different widths 68, 74. The right stringer 25 is comprised of cord 26 and spaced coupling elements 74 having only a singe width.

Figure 6:
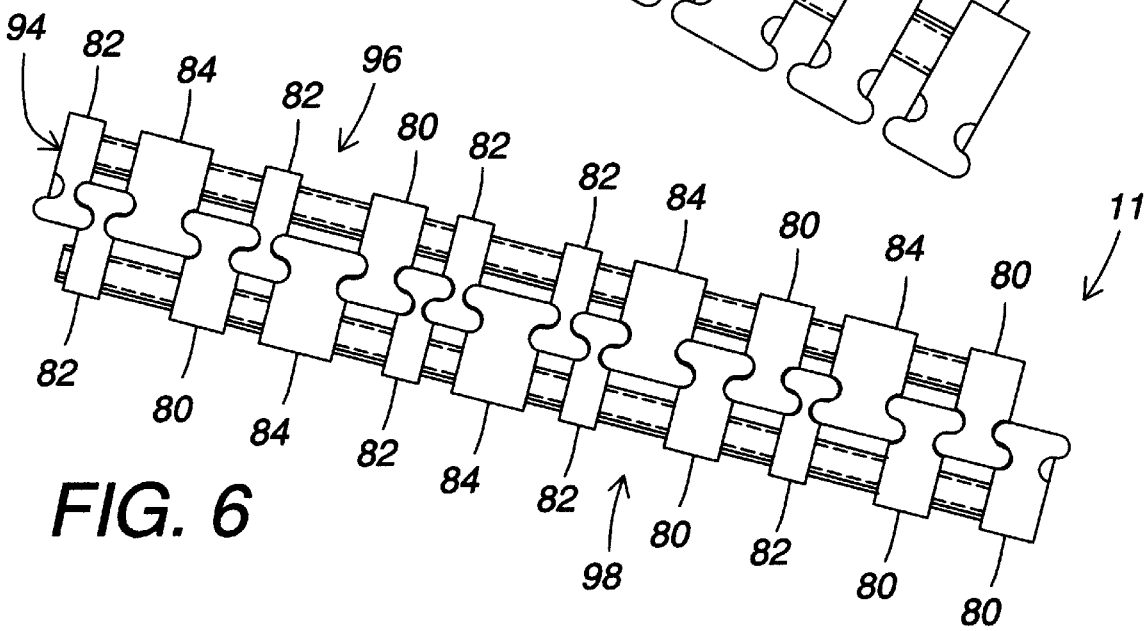
FIG. 6 is a plan view of a segment of a closed zipper carrying coded information.

The right stringer 10 shown in FIG. 6 has coupling elements 80, 82, 84 having three different widths mounted to cord 90. If, arbitrarily, the widest element 84 is interpreted as a space, the narrowest element 82 as a dot, and element of intermediate width 80 as a dash, then reading from stringer end 92, the stringer encrypts the word "denim" in Morse code.

In FIG. 6, the zipper pitch sequence starting from zipper end 94 is used to encode the word "indigo" in Morse code. The same meaning is given to the coupling elements 80, 82, 84 as in FIG. 6, except that the reading of zipper 11 starts at end 54 of stringer 96 and proceeds alternately between stringer 96 and stringer 98, so that all of the coupling elements in the zipper segment 11 are employed. Of course, the Morse code example used here is only one of many such coding systems that may be used within the scope of the present invention. Such patterned zippers, whether encrypting or not, are readily distinguished from plain zippers and, due to the higher cost of manufacturing molds for such special tooth arrangements, the cost of counterfeiting is increased, and thereby discouraged.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

I claim:

1. A zipper, comprising:

a slider;

a first stringer comprising a first plurality of coupling elements having a first coupling element pitch sequence, said first coupling element pitch sequence comprising a first coupling element spacing and at least a second coupling element spacing different from said first coupling element spacing; and a second stringer comprising a second plurality of coupling elements having a second coupling element pitch sequence complementary to said first coupling element pitch sequence, so that said first plurality of coupling elements may be reversibly interleaved and interlocked by said slider with said second plurality of coupling elements.

2. A zipper as recited in claim 1, wherein said first coupling element spacing is at least ten percent larger or smaller than said second coupling element spacing.

3. A zipper as recited in claim 1, wherein one or more of said first plurality of coupling elements having said first coupling element spacing alternate at least once with one or more of said first plurality of coupling elements having said second coupling element spacing.

4. A zipper as recited in claim 1, wherein said first coupling element spacing is at least five percent larger or smaller than said second coupling element spacing.

5. A zipper as recited in claim 4, wherein one or more of said first plurality of coupling elements having said first coupling element spacing alternate at least five times with one or more of said first plurality of coupling elements having said second coupling element spacing.

6. A zipper as recited in claim 1, wherein said first coupling element spacing is at least one percent larger or smaller than said second coupling element spacing.

7. A zipper as recited in claim 6, wherein one or more of said first plurality of coupling elements having said first coupling element spacing alternate at least once with one or more of said first plurality of coupling elements having said second coupling element spacing.

8. A zipper as recited in claim 6, wherein one or more of said first plurality of coupling elements having said first coupling element spacing alternate at least five times with one or more of said first plurality of coupling elements having said second coupling element spacing.

9. A zipper as recited in claim 1, wherein one or more of said first plurality of coupling elements having said first coupling element spacing alternate at least five times with one or more of said first plurality of coupling elements having said second coupling element spacing.

10. A zipper as recited in claim 9, wherein said first coupling element spacing and said second coupling element spacing are alternated so as to form a zipper pitch sequence encoding informational content.

11. A zipper as recited in claim 9, wherein said first coupling elements are fixed to a first flexible strip or cord, and said second coupling elements are fixed to a second flexible strip or cord.

12. A first zipper stringer for reversibly interlocking with a second zipper stringer comprising: a plurality of first coupling elements having a first width equal to one half of a first coupling element spacing of a closed zipper having coupling elements identical to said first plurality of coupling elements, and a plurality of second coupling elements having a second width equal to one half of a second coupling element spacing of a closed zipper having coupling elements identical to said second plurality of coupling elements, wherein said plurality of first coupling elements each have a single substantially rigid first projection that is rotatable relative to adjacent coupling elements, and wherein said plurality of second coupling elements each have a single substantially rigid second projection that is rotatable relative to adjacent projections, whereby the first zipper stringer comprises a first coupling element pitch sequence comprising said first coupling element spacing and at least said second coupling element spacing, wherein said second coupling element spacing is different from said first coupling element spacing.

13. A zipper as recited in claim 12, wherein said first coupling element spacing alternates with said second coupling element spacing at least once.

14. A zipper comprising the first zipper stringer as recited in claim 12, and a second zipper stringer joinable to the first zipper stringer, said second zipper stringer having a second coupling element pitch sequence complementary to said first coupling element pitch sequence.

15. A zipper as recited in claim 14, further comprising a slider for joining said first stringer to said second stringer.

16. A zipper as recited in claim 14, wherein said first coupling element spacing is at least one percent larger or smaller than said second coupling element spacing.

17. A zipper as recited in claim 14, wherein said first coupling element spacing is at least five percent larger or smaller than said second coupling element spacing.

18. A zipper as recited in claim 14, wherein said first coupling element spacing is at least ten percent larger or smaller than said second coupling element spacing.

19. A zipper as recited in claim 12, wherein at least one of said plurality of first coupling elements having a first width alternates at least five times with at least one of said plurality of second coupling elements having a second width.

20. A zipper as recited in claim 19, wherein said first coupling element spacing and said second coupling element spacing are alternated so as to form a zipper pitch sequence encrypting informational content.

21. A zipper as recited in claim 20, wherein said informational content is encrypted in Morse code.

22. A zipper as recited in claim 19, wherein said first coupling elements are fixed to at least one first flexible strip or cord, and said second coupling elements are fixed to at least one second flexible strip or cord.

23. A zipper as recited in claim 22, wherein said fast coupling elements comprise first surface contours, and said second coupling elements comprise second surface contours, whereby said first surface contours interlock with said second surface contours when said first coupling elements are interleaved with said second coupling elements.

24. A zipper as recited in claim 22, wherein said first coupling elements and said second coupling elements are fixed to said at least one first flexible strip or cord and at least one second flexible strip or cord respectively by continuous injection molding of a thermoplastic material.

* * * * *